US005845549A

United States Patent [19]

Bouligny

[11] Patent Number: 5,845,549

[45] Date of Patent: Dec. 8, 1998

[54] POWER TONG GRIPPING RING MECHANISM

[75] Inventor: Vernon J. Bouligny, Lafayette, La.

[73] Assignee: Frank's Casing Crew and Rental Tools, Inc., Lafayette, La.

[21] Appl. No.: 966,799

[22] Filed: Nov. 10, 1997

Related U.S. Application Data

[63] Continuation of Ser. No. 575,560, Dec. 20, 1995, abandoned.

[51] Int. Cl.[6] ..... B25B 13/50

[52] U.S. Cl. ..... 81/57.33; 81/57.34; 81/57.18

[58] Field of Search ..... 81/57.33, 57.34, 81/57.35, 57.15, 57.16, 57.18, 57.24

[56] References Cited

U.S. PATENT DOCUMENTS

| | | | |
|---|---|---|---|
| Re. 31,699 | 10/1984 | Eckel | 73/862.25 |
| 2,846,909 | 8/1958 | Mason | 81/53 |
| 2,989,880 | 6/1961 | Hesser et al. | 81/53 |
| 3,023,651 | 3/1962 | Wallace | 81/57.18 |
| 3,196,717 | 7/1965 | Sheppard | 81/57 |
| 3,371,562 | 3/1968 | Kelley | 81/54 |
| 3,703,111 | 11/1972 | William | 81/57.34 |
| 4,246,809 | 1/1981 | Keast et al. | 81/57.18 |
| 4,334,444 | 6/1982 | Carstensen | 81/57.18 |
| 4,357,843 | 11/1982 | Peck et al. | 81/57.16 |
| 4,402,239 | 9/1983 | Mooney | 81/57.16 |
| 4,404,876 | 9/1983 | Eckel | 81/87.18 |
| 4,492,134 | 1/1985 | Reinboldt | 81/57.34 |
| 4,590,823 | 5/1986 | Neves et al. | 81/57.14 |
| 4,836,064 | 6/1989 | Slator | 81/57.18 |
| 5,060,542 | 10/1991 | Hauk | 81/57.34 |

*Primary Examiner*—David A. Scherbel
*Assistant Examiner*—Joni B. Danganan
*Attorney, Agent, or Firm*—Matthews, Joseph, Shaddox & Mason, P.L.L.C.; Henry L. Ehrlich

[57] ABSTRACT

A multi-sectioned, bidirectional gripping ring for a closed-head power tong is disclosed of the inventive gripping ring have an open position in which a pipe may be placed within or removed from the gripping ring and a closed position in which the gripping ring completely encircles the pipe. The inventive gripping ring uses radially moveable dies in circumferentially moveable die carriers to grip the pipe. The dies are synchronously moved in the radial direction to grip or release the pipe by changing their circumferential position with respect to the cams in the gripping ring housing.

18 Claims, 5 Drawing Sheets

POWER TONG GRIPPING RING MECHANISM

This application is a continuation of application Ser. No. 08/575,560, filed Dec. 20, 1995, now abandoned.

FIELD OF THE INVENTION

The present invention relates to oil field operations for making up and breaking apart tubing joints and more specifically relates to a power tong which is longitudinally connectable to a pipe string and is suitable for operations on single or multiple string tubing operations.

BACKGROUND OF THE INVENTION

Tongs are used in oil field operations to grip and rotate joints of pipe to make up (screw together) or break apart (screw apart) the pipe. These operations typically require two tongs: a tong which is used to rotate the upper pipe; and a backup tong which is used to hold the lower pipe and prevent its rotation. The upper tong is commonly a power tong which has a mechanism to grip and rotate the pipe while the body or housing of the tong remains stationary.

Power tongs can be classified by various characteristics, one of which is whether the tong has an open or closed throat. . Closed-head tongs have a generally annular shaped ring which fits around the pipe in order to grip and rotate it. Closed-head tongs are typically capable of transmitting more torque to a pipe, but prior art closed-head tongs typically are not easily placed on the pipe from a position lateral to the pipe. Some prior art closed-head tongs cannot be moved laterally onto a pipe at all. Prior art closed-head tongs are also typically large enough and cannot easily be used with dual tubing strings without splaying the tubing strings to allow the tong to be placed on either of the strings.

Open-throat tongs, on the other hand, are much easier to move laterally onto a pipe. Open-throat tongs, however, generally cannot develop the torque of a closed-head tong and are susceptible to spreading of the open throat portion of the gripping member in high torque situations.

The prior art thus teaches that the design of a power tong involves a choice between the advantages of a closed-head tong (i.e., high radial gripping force capability) and the advantages of an open-throat tong (i.e., the ease with which the tong is moved laterally onto and off of pipes). If a closed-head design was chosen, it was accompanied by the disadvantage of not being able to move it laterally onto pipes. If the open-throat was chosen, it was accompanied by the disadvantage of reduced radial gripping force.

SUMMARY OF THE INVENTION

The present invention combines the advantages of a closed-head tong (high radial gripping force capability) with the advantages of an open-throat tong (ease of lateral movement onto the pipe) without suffering form the disadvantages of either. This is accomplished by utilizing a multi-sectioned gripping ring to allow ease of lateral positioning of the tong on the pipe string while still developing the high radial clamping forces and torques which are characteristic of closed-head tongs.

The gripping ring of the invention has circumferentially slidable die carriers which hold radially movable dies. As the housing rotates, the die carriers slide circumferentially, and cams in the housing and on the dies force the dies radially inward to grip the pipe. Return of the die carriers to their rest positions with respect to the housing allows the dies to move radially outward from the pipe, thereby releasing it. The invention further contains an indexing mechanism to ensure the alignment of the housing and slidable die carriers so that the housing and gripping mechanism can be easily opened for positioning on the pipe or taking the invention off the pipe.

It is therefore an object of the invention to provide a power tong which provides the high clamping force necessary for the high torque output of a closed-head tong while allowing the ease of use of an open throat tong by utilizing a hinged housing which completely surrounds the pipe in the closed position, but allows the tong to engage the pipe by moving the tong in its open position laterally onto the pipe.

It is another object of the invention to provide a power tong which is small enough to be easily used with dual pipe strings while still developing sufficient torque to make up or break apart pipe joints.

It is another object of the invention to provide an improved bi-directional gripping mechanism which also ensures synchronous movement of dies and die carriers in a power tong.

It is yet another object of the invention to provide a multi-sectioned, gripping ring which has an indexing mechanism to insure alignment of the die carriers and section members so that the gripping ring can be easily opened.

DETAILED DESCRIPTION OF THE PREFERRED EMBODIMENT

Figure 1:
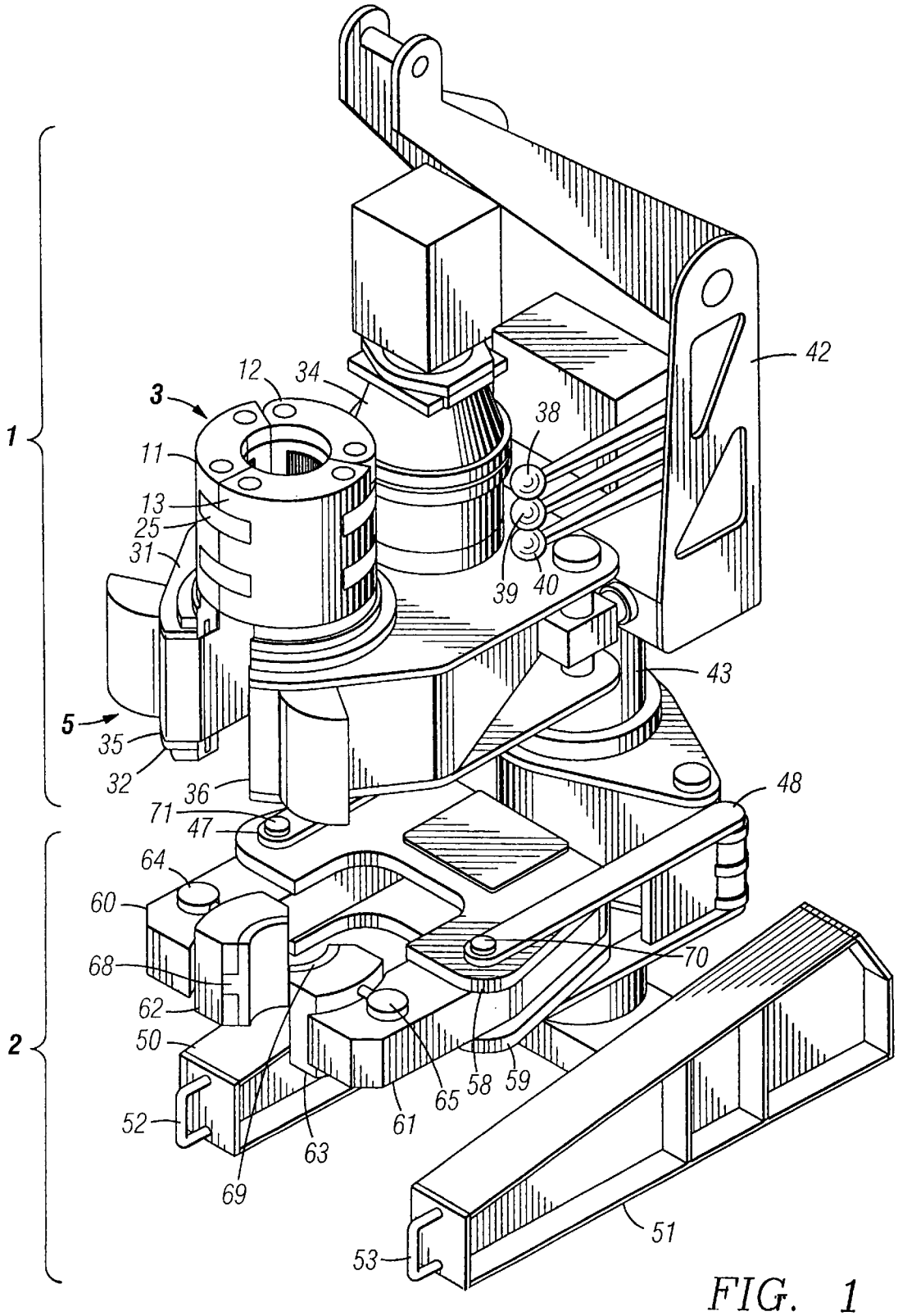
FIG. 1 is a perspective view of a power tong showing the inventive gripping ring in a closed position.
Figure 2:
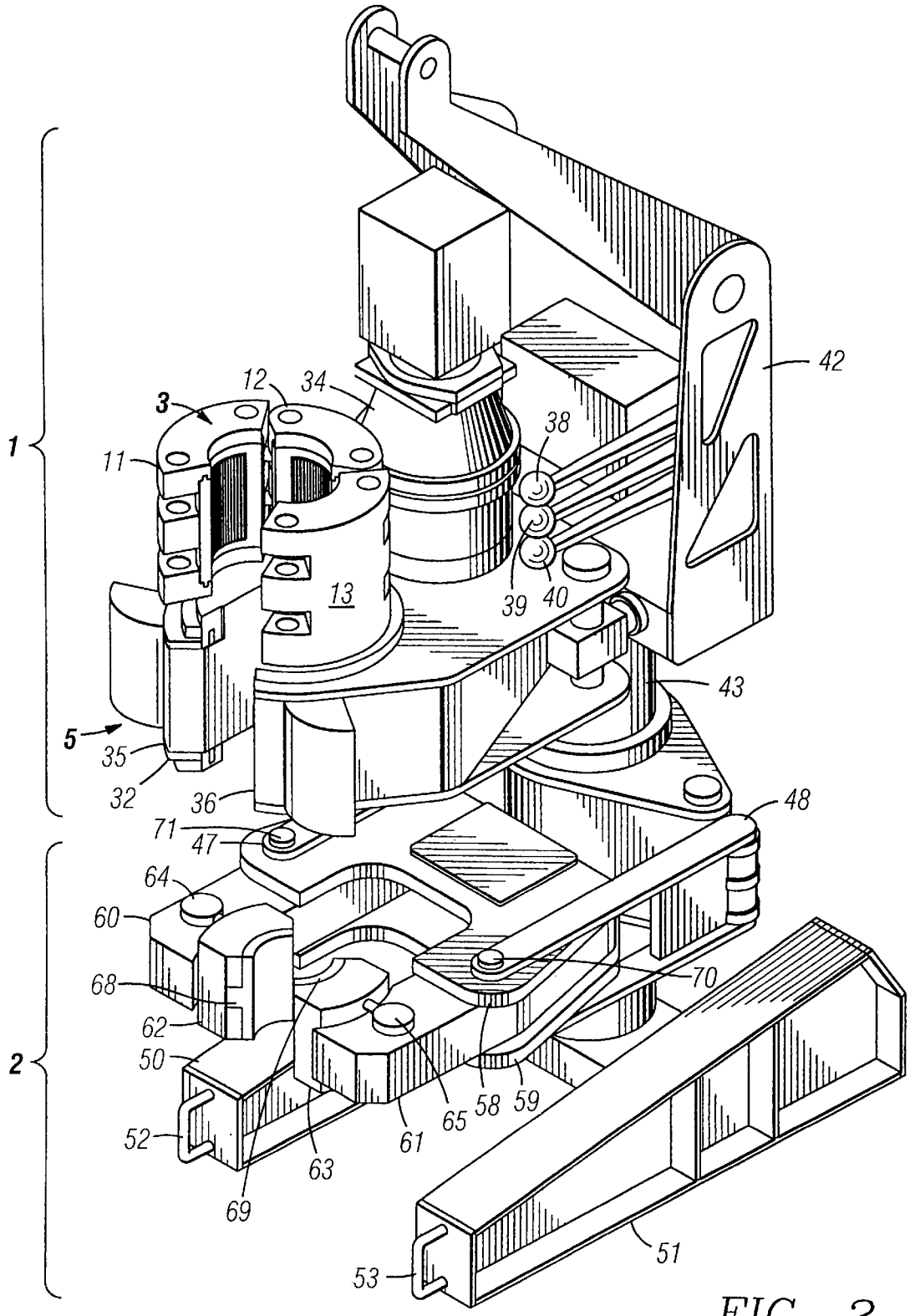
FIG. 2 is a perspective view of a power tong showing the inventive gripping ring in an open position.

Referring to FIGS. 1 and 2, the inventive gripping ring 3 is shown. Power tong 1 utilizes gripping ring 3 with tong body 5 to grip and rotate a pipe section (not shown). Backup tong 2 holds the pipe coupling, which is mated to the pipe, stationary while the pipe is rotated by power tong 1. Because of the design of the inventive gripping ring 3, the annular thickness of the gripping ring is small enough that the power tong can be used on one of two adjacent pipe strings in a multiple-string operation without having to splay two pipes apart. Nevertheless, the inventive tong can still develop the necessary gripping force and torque to make up or break apart the pipe sections and pipe couplings.

In the closed position, the housing of gripping ring 3 forms a cylindrical or annular shape. The housing comprises housing sections 11, 12, 13. The gripping ring 3 is mounted on top of tong body 5 which houses the drive mechanism (not shown) which rotates gripping ring 3. The drive mechanism is enclosed within the body which is formed by upper plate 31, lower plate 32, and side walls 35 and 36. The drive mechanism is powered by motor 34 and is operated by controls 38, 39 and 40.

Power tong 1 is connected to frame 42. Frame 42 is in turn connected to torque post 43 which is connected to backup tong 2 via swing arms 47, 48. When gripping ring 3 is rotated to engage a pipe, the torque which is transferred to the power tong is transferred through the torque post to the backup tong and finally to the pipe coupling, thereby causing the pipe, rather than the power tong, to rotate. A pair of structural arms 50, 51 having handles 52, 53 are connected to the lower end of torque post 43 to assist the tong operator in positioning the power tong and backup tong.

Because the inventive power tong is adapted for use in multiple pipe string operations, it is ideally used in conjunction with a backup tong which is also suitable for use with multiple pipe strings. Such a backup tong is shown in FIGS. 1 and 2. The backup tong shown in these figures generally comprises upper plate 58, lower plate 59, jaw members 60 and 61, and gripping members 62 and 63. The backup tong is connected to torque post 43 by swinging arms 47 and 48 so that the backup tong can move laterally with respect to the torque post, but cannot rotate with respect to the torque post.

The backup tong 2 has an actuator disposed between upper plate 58 and lower plate 59 which forces the ends of jaw members 60 and 61 outward. Jaw members 60 and 61 pivot around pivot bolts 70 and 71 causing gripping members 62 and 63 to move closer to each other. When gripping members 62 and 63 are positioned around a pipe, dies 68 and 69 are brought into contact with the pipe to grasp it and hold it stationary. As dies 68 and 69 begin to engage the pipe, gripping members 62 and 63 are allowed to pivot about pivot connections 64 and 65. This allows dies 68 and 69 to move somewhat so that the curved faces of the dies can fully engage the pipe even when it is not perfectly centered between gripping members 62 and 63 and on the center line of backup tong 2.

Figure 3:
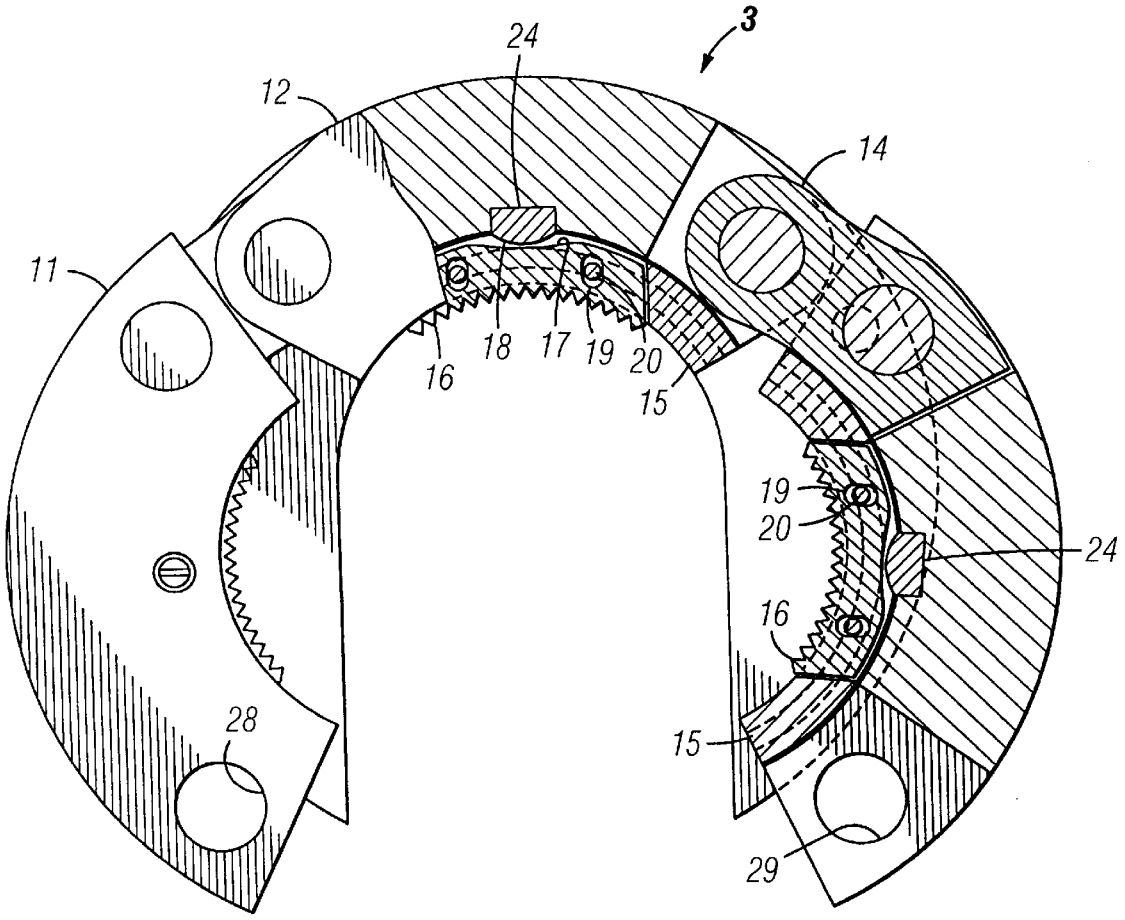
FIG. 3 is a partial cut-away plan view of the inventive gripping ring in the open position.
Figure 4:
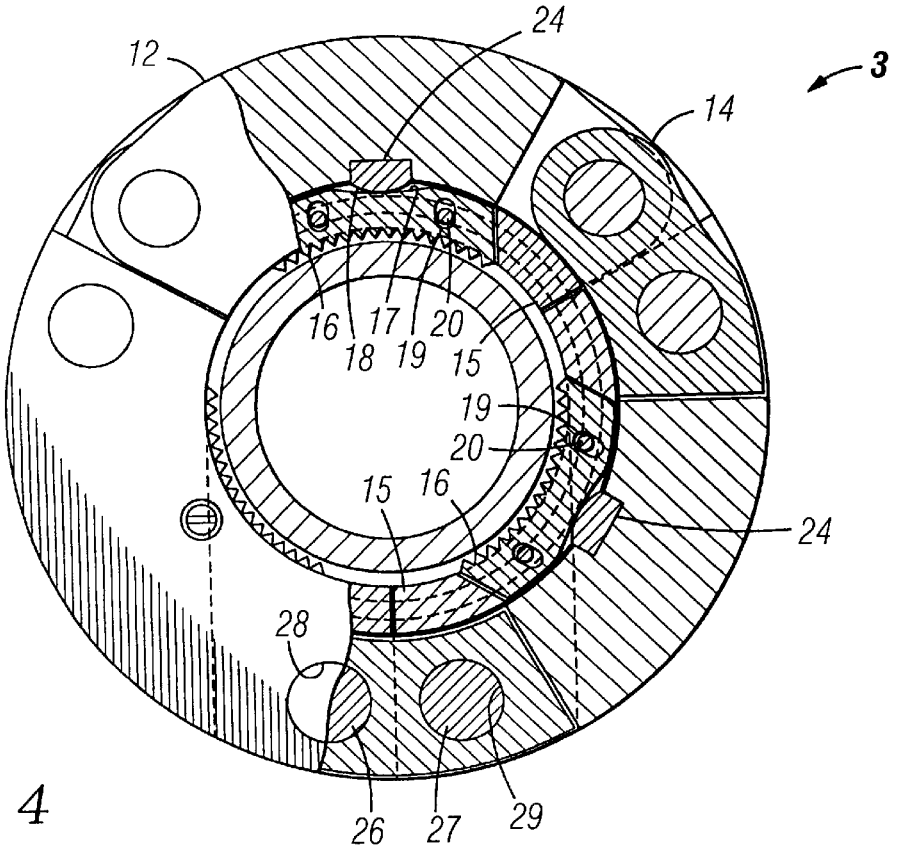
FIG. 4 is a partial cut-away plan view of the inventive gripping ring in the closed position, with die carriers in their indexed positions.
Figure 5:
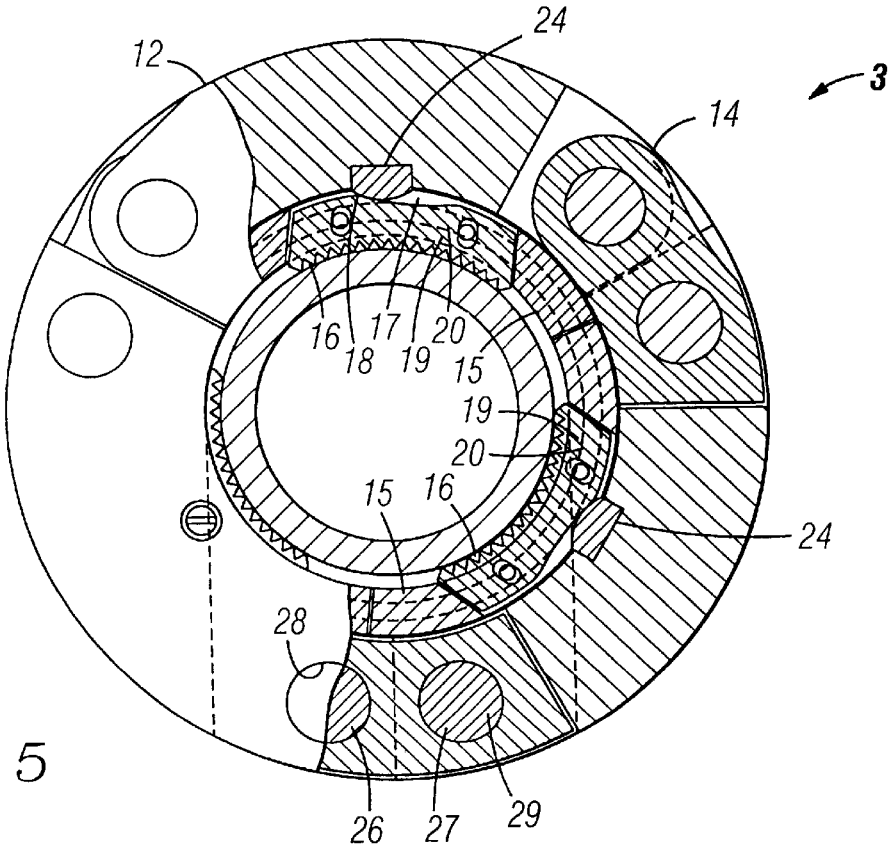
FIG. 5 is a partial cut-away plan view of the inventive gripping ring in the closed position with the die carriers offset from their indexed positions, and the dies engaging the pipe.

Referring to FIGS. 3–5, the preferred embodiment of the gripping ring 3 is shown. A gripping ring housing is formed by housing sections 11, 12, 13. In the closed position, the housing sections 11–13 have a generally cylindrical shape with a coaxial opening therethrough, into which a pipe fits. The gripping ring may also be described as annular in shape. The central housing section 12 is connected to swinging housing sections 11, 13 by hinges 14. The hinges allow the sections to open or swing outward so that a pipe can be placed between the sections and the sections thereafter closed around the pipe. The open gripping ring is shown in FIGS. 2 and 3, while the closed gripping ring is shown in FIGS. 1, 4 and 5. In the closed position, outer sections 11 and 13 are latched together by a locking latch mechanism.

While the entire latch mechanism is not shown in the Figures, it can be seen in FIGS. 4 and 5 that the latch holds the swinging housing sections 11, 13 together by moving a pair of locking bars 26, 27 through a pair of apertures 28, 29 in the swinging housing sections. Each of the apertures 28, 29 extends through one of the housing sections 11, 13 when gripping ring 3 is in the open position. When ring 3 is in the closed position, each aperture 28, 29 extends through a housing section 11,13 and both extend through latching member 25. When the housing sections are in the closed position, the apertures are aligned through the housing sections and the latching member so that locking bars 26, 27 can be placed in apertures 28, 29 to hold the non-hinged ends of the housing sections together, thereby holding them in the closed position.

A die carrier 15 is slidably mounted on the inner face of each housing section 11, 12, 13. The die carriers 15 cover angular sections equal to those of housing sections 11, 12 13. Thus, the edges of the die carriers 15 are radially aligned with the corresponding edges of housing sections 11, 12, 13 when the gripping ring is in its indexed position. See FIG. 4. When the housing sections are in closed position, the die carriers 15 slide circumferentially along the face of their corresponding housing sections so that the die carriers overlap with adjacent housing sections (see especially FIG. 5).

Figure 6:
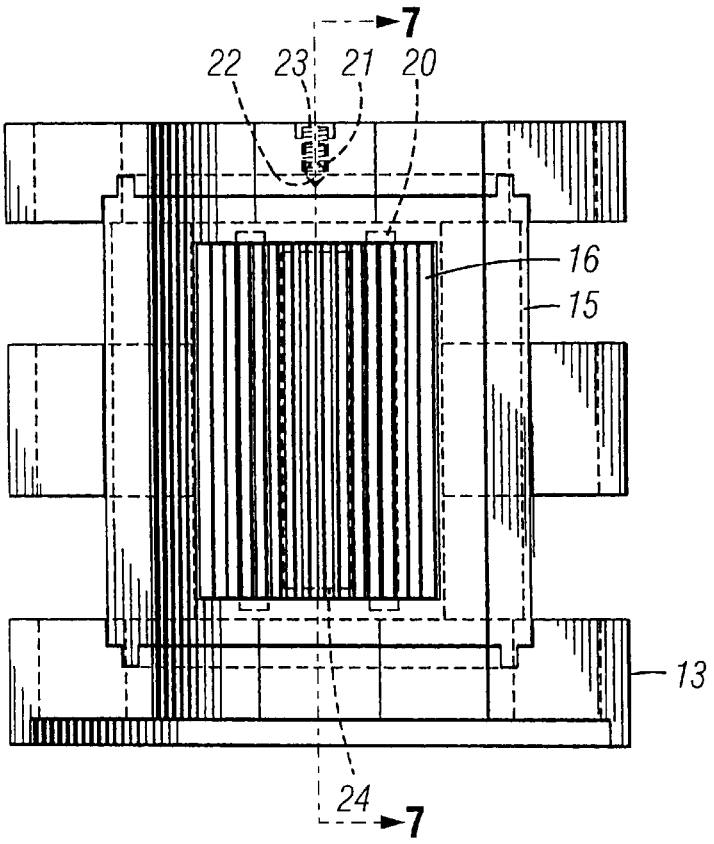
FIG. 6 is an elevation view of the center section of the inventive gripping ring.

Referring to FIGS. 3 and 6, dies 16 are mounted within the die carriers 15. Each die 16 is mounted within an opening in the die carrier 15 so that it may move radially, either toward or away from its respective housing section. Dies 16 are restricted to radial movement by the walls of the openings through die carriers 15, as well as by pins 20 which fit into slots 19. The radial travel of each die 16 is limited by pins 20 which extend from die 16 into slots 19 in die carrier 15.

Dies 16 have two curved faces, one which is concave and one which is generally convex. The concave faces of the dies are gripping faces and have approximately the same curvature as the pipe to be gripped. The gripping faces of the dies have ridges, or teeth, which run parallel to the axis of the annular gripping ring to reduce slippage between the dies and the pipe as the gripping ring rotates the pipe. Any suitable type of texturing or knurling may be used on the concave face of the dies to enhance the grip of the dies on the pipe.

On the opposite, convex side of dies 16 are smooth camming surfaces 17. A cam 24 is mounted in each housing section behind die 16. The camming surface 17 of die 16 faces cam 24. The surface of cam 24 which faces die 16 is normally in contact with the generally convex camming surface 17. The contacting surfaces of cam 24 and die 16 are shaped so that, when the die 16 and die carrier 15 are in their indexed positions (i.e., centrally located on the housing section), the die 16 can move radially outward, toward the housing section and away from the pipe as shown in FIG. 4. When die 16 and die carrier 15 are offset from their indexed, central location with respect to the housing section, the cam 24 presses against the outer portion of camming surface 17 of die 16, forcing die 16 to move radially inward, away from the housing section and toward the pipe as shown in FIG. 5.

In the preferred embodiment, the camming surface 17 of die 16 is symmetric, so that the die is forced to move radially inward the same distance, whether the die and die carrier are moved a given amount clockwise or that same amount counterclockwise from the indexed position with respect to the housing section. The die is slightly thinner at its center (allowing the die in its central, indexed position to rest radially outward from and out of contact with the pipe) and its thickness gradually increases as the distance from its center increases (forcing the die radially inward as the thicker portion of the die is moved into a position between cam 24 and the pipe).

The dies 16 of the preferred embodiment are removable by sliding the die carrier 15 out of its respective housing section and then sliding the die out of the convex side of the die carrier. The dies can thus be easily exchanged with a set having a different thickness or curvature to more exactly fit different sizes of pipe (although the invention is inherently capable of gripping pipes of various diameters).

Figure 7:
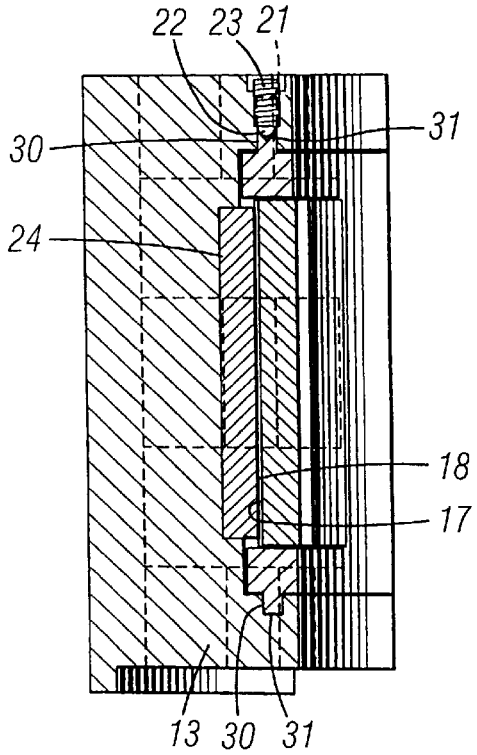
FIG. 7 is a cross-section of the gripping ring section of FIG. 6.

Referring to FIG. 7, each housing section has a generally C-shaped cross-section into which die carrier 15 fits. Die carrier 15 has a tongue or ridge 30 along its upper edge which fits into a corresponding groove 31 at the top of the housing section's C-shape. The die carrier 15 also has a ridge 30 along its bottom edge which fits into a corresponding groove in the bottom of the housing section's C-shape. Thus, die carrier 15 is prevented from moving radially, but is allowed to slide circumferentially in the housing section. As explained above, the die carriers can be slid out of the housing sections when the housing is in the open position so that dies or even the die carriers can be replaced. In the preferred embodiment, ridges 30 have beveled corners so that the die carriers are easily inserted into grooves 31.

The housing sections of the preferred embodiment also have a pin 21 retractably mounted therein for use as an indexing mechanism. The die carrier 1 has a corresponding indentation 22 so that, when the die carrier is centered in its location within the housing section, pin 21 is urged into indentation 22 by spring 23. This indexing mechanism overcomes a problem resulting from the overlap of die carriers with adjacent housing sections as shown on FIG. 5. This overlap causes interference between the die carriers and housing sections so that movement of the housing sections from the closed position to the open position is impaired or even prevented. Even though the tong operator cannot see the die carriers to align them with the housing sections, the indexing mechanism allows the tong operator to ensure their alignment before opening the housing sections and possibly damaging the gripping ring.

A tong utilizing the inventive gripping ring is operated as follows. First, the closed gripping ring is rotated until the die carriers are in their indexed positions. The housing sections are then moved to the open position and the tong is positioned laterally so that a pipe is disposed within the throat of the open gripping ring. The housing sections of the gripping ring are then closed over the pipe and latched in the closed position. A brake band (not shown in the drawings) applies friction to the die carriers to prevent them from moving until the dies are firmly engaged with the pipe. As the gripping ring is rotated from the central, indexed position, the die carriers are held stationary by an external brake band while the housing sections and cams rotate. The housing sections thus move circumferentially with respect to the die carriers. As the housing sections move relative to the die carriers, cam 24 and cam surface 17 of die 16 engage and force the dies inward toward the pipe. As the dies 16 engage the pipe, radial movement of the dies is stopped and the die carriers 15 are prevented from further motion relative to the housing sections (i.e., they can no longer stay stationary while the housing rotates). The rotational force applied by the housing to the die carriers at that point overcomes the frictional force of the brake band, causing the die carrier and the pipe to rotate.

From the foregoing disclosure, many modifications to the invention will be apparent to persons skilled in the art without departing from the scope of the invention. The embodiments described above are exemplary rather than exhaustive and such modifications are contemplated by the invention.

What is claimed is:

1. A gripping ring for a power tong used to grip and rotate pipes in subterranean drilling and production operations, said gripping ring being laterally connectable to a pipe string said gripping ring being without an outer stationary housing, the gripping ring comprising:

a rotatable housing having a plurality of sections which are movably attached to each other, the housing having a closed position in which the sections form an annulus, the housing also having an open position in which a pipe can be moved into the annulus;

a plurality of movable die carriers disposed within the housing;

a plurality of dies, each die having a gripping surface and a camming surface, each die being disposed within one of the die carriers so that the gripping surface of the die faces radially inward, each die being radially movable within the die carrier, the camming surface of each die being in contact with a camming surface of the housing; and the camming surfaces being shaped so that, in an indexed position, the dies are disposed radially outward from engagement with a pipe in the annulus of the housing and as the die carriers and dies are moved circumferentially away from the indexed position with respect to the housing, the dies are forced radially inward to engage the pipe in the annulus of the housing.

2. The power tong gripping ring of claim 1 wherein each die carrier is in contact with the adjacent die carriers so that the circumferential movement of each die carrier is identical.

3. The power tong gripping ring of claim 2 wherein the camming surfaces are shaped so that the amount of radial movement of the dies caused by a set amount of clockwise movement of the die carriers within the housing is equal to the amount of radial movement of the dies caused by the set amount of counterclockwise movement of the die carriers within the housing.

4. The power tong gripping ring of claim 3 wherein each camming surface is substantially symmetric.

5. The power tong gripping ring of claim 3, further comprising an indexing mechanism which indicates an indexed position of the die carriers with respect to the housing.

6. The power tong gripping ring of claim 5 wherein the indexing mechanism comprises a pin in the housing which is urged into contact with the die carriers, and an indentation in at least one of the die carriers, the pin and indentation being positioned so that the pin rests in the indentation when the die carriers are in the indexed position.

7. The power tong gripping ring of claim 2 further comprising an indexing mechanism which indicates an indexed position of the die carriers with respect to the housing.

8. The power tong gripping ring of claim 1 wherein the dies are removable from the die carriers.

9. The power tong gripping ring of claim 1 further comprising an indexing mechanism which indicates an indexed position of the die carriers with respect to the housing.

10. An improved gripping mechanism for a power tong used in multiple pipe string operations to grip and rotate a pipe string adjacent to another pipe string without the need to splay the pipe strings, said gripping mechanism being laterally connectable to a pipe string, said gripping mechanism being without an outer stationary housing, said gripping mechanism comprising:

a generally annular, rotatable housing having an annular wall thickness which is less than an open space between the adjacent pipe strings;

a plurality of movable dies, each die having a gripping surface and a camming surface disposed within the housing so that the gripping surfaces face radially inward toward an annulus defined by the housing; and, a plurality of camming surfaces disposed within the housing and facing the camming surfaces of the dices, the camming surfaces to move the dies closer or farther from the annulus.

11. The power tong gripping mechanism of claim 10 wherein the housing comprises a plurality of sections which are movable between an open position in which a pipe can be moved into position between the sections and a closed position in which the sections form a complete annulus within which a pipe may be disposed.

12. The improved power tong gripping mechanism of claim 11 wherein the dies are caused to moved inward or outward simultaneously and at the same rate.

13. The improved power tong gripping mechanism of claim 12 wherein the movement of the camming surfaces with respect to the dies is caused by the rotation of the housing with respect to the dies.

14. The improved power tong gripping mechanism of claim 13 wherein the camming surfaces and dies have an indexed position in which the dies are at their outward most position from the center of the annulus, the dies being forced inward from their outermost position as the housing is rotated in either direction, causing the camming surfaces and dies to move away from the indexed position.

15. The improved power tong gripping mechanism of claim 12 further comprising a plurality of die carriers disposed within the housing, each die being disposed within one of the die carriers and being radially movable within the die carriers, the die carriers being circumferentially movable within the housing.

16. The improved power tong gripping mechanism of claim 15, wherein the die carriers form an annular shape when the housing is in the closed position, the annulus formed by the die carriers being concentric with the annulus formed by the housing.

17. The improved power tong gripping mechanism of claim 16, further comprising an indexing mechanism, the indexing mechanism indicating a position in which the die carriers are aligned with the sections of the housing.

18. A power tong for making and breaking connections between tubular members adapted for use in multiple string operations, said power tone being laterally connectable to a pipe string, said power tong being without an outer stationary housing, the power tong comprising:

a rotatable gripping ring forming an annulus, said ring having a pair of swinging housing sections hingedly connected to a central section, said swinging sections being movable between an open position for positioning a tubular member within said annulus and a closed position encircling said tubular member;

a die carrier slidably carried by each said section of said ring;

a die radially, movably connected to each said die carrier, said die having a camming surface and a gripping surface, said gripping surface being oriented towards said annulus; and a cam extending inwardly from each said section adapted for engaging said camming surface of said die;

wherein when said cam and said camming surface are in an indexed position said die is disengaged from said tubular member, and when said ring is rotated, said cam contacts said cramming surface of said die radially urging said gripping surface of said die inward engaging said tubular member and rotating said tubular member in the same direction as said ring rotates.

* * * * *